US007021307B1

(12) United States Patent
Ogata

(10) Patent No.: US 7,021,307 B1
(45) Date of Patent: Apr. 4, 2006

(54) ROTARY CUTTING SAW

(75) Inventor: Seiya Ogata, Ukiha-gun (JP)

(73) Assignees: Noritake Co., Limited, Nagoya (JP); Noritake Super Abrasive Co., Ltd., Ukiha-gun (JP)

( * ) Notice: Subject to any disclaimer, the term of this patent is extended or adjusted under 35 U.S.C. 154(b) by 0 days.

(21) Appl. No.: 10/989,316

(22) Filed: Nov. 17, 2004

(51) Int. Cl.
*B28D 1/04* (2006.01)

(52) U.S. Cl. ..... 125/15; 451/547

(58) Field of Classification Search ..... 125/13.01, 125/15, 18; 451/547, 542, 541
See application file for complete search history.

(56) References Cited

U.S. PATENT DOCUMENTS

| | | | | |
|---|---|---|---|---|
| 6,408,838 | B1 * | 6/2002 | Ogata et al. | 125/15 |
| 6,568,383 | B1 * | 5/2003 | Spangenberg | 125/15 |
| 6,638,152 | B1 * | 10/2003 | Kim et al. | 451/541 |
| 6,638,153 | B1 * | 10/2003 | Lee et al. | 451/547 |
| 6,845,767 | B1 * | 1/2005 | Sakarcan | 125/15 |

FOREIGN PATENT DOCUMENTS

| | | | |
|---|---|---|---|
| JP | A 58-10461 | 1/1983 | |
| JP | A 9-508589 | 9/1997 | |
| JP | A 10-58330 | 3/1998 | |
| JP | A 10-128671 | 5/1998 | |
| JP | A 10-329034 | 12/1998 | |
| JP | A 11-309711 | 11/1999 | |
| JP | A 2001-150353 | 6/2001 | |
| JP | 2004-291183 | * 10/2004 | |

* cited by examiner

*Primary Examiner*—Dung Van Nguyen
(74) *Attorney, Agent, or Firm*—Oliff & Berridge, PLC

(57) ABSTRACT

A rotary cutting saw includes a base disk; and a plurality of abrasive segments which are fixed to an outer circumferential surface of the base disk, and which have respective outer surfaces cooperating with each other to constitute an outer circumferential surface of the rotary cutting saw; wherein each of the abrasive segments has at least one recess opening in the outer surface thereof; wherein each of the at least one recess has a radially outer portion and a radially inner portion which is located inwardly of the radially outer portion as viewed in a radial direction of the base disk; and wherein the radially outer portion has a width that is constant in the radial direction, and the radially inner portion has a width that varies in the radial direction.

15 Claims, 5 Drawing Sheets

ROTARY CUTTING SAW

This application is based upon Japanese Patent Application No. 2002-279879 filed Sep. 25, 2002 and laid open Apr. 15, 2004, the contents of which are incorporated hereinto by reference.

FIELD OF THE INVENTION

The present invention relates to a rotary cutting saw substantially to groove hard brittle materials such as stone, concrete and refractories.

DESCRIPTION OF RELATED ART

A conventional rotary cutting saw having a base disk and abrasive segments including abrasive grains such as diamond is employed as a grindstone for grooving hard brittle materials such as stone, concrete and refractories. Substantially the same width of the abrasive segment as the width of a groove is required for grooving hard brittle materials to remove materials in an area having the width equal to that of the segment. Only heavy-duty grooving machine can make wide grooves to remove a large amount of the material with the abrasive grains in the segments thrusted into the material. A wide groove causes the dispersion of the force of the grooving machine to the abrasive grains in the segments and the small thrust of the grains into the material.

JP 10-128671 A (Cols. 0009–0012)

JP 58-10461 A (FIGS. 8–13)

JP 10-329034 A (FIGS. 1 and 7)

JP 10-58330 A (FIGS. 1, 2 and 5)

JP 2001-150353 A (FIG. 1)

JP 11-309711 A (Cols. 0012–0014)

JP 9-508589 A (FIGS. 2 and 3)

A diamond grindstone for cutting having practically short abrasive segments with grooves (slits) to substantially divide the segments is disclosed as an improvement in JP 10-128671 A, JP 58-10461 A, JP 10-329034 A, JP 10-58330 A and JP 2001-150353 A. And a diamond cutting saw having slits in the segments and having other material in the slits is disclosed in JP 58-10461 A and JP 11-309711 A. However, these improvements are short in thrusting for grooving hard materials such as hard concrete and stone of remarkable abrasive grain deterioration while small contact area of the segment to the work material allows the effective thrust of the abrasive grains to the work material.

Other improvements of the grinding tool having grinding segments and segments including superabrasive grains disposed one after the other and the tool having two kinds of segments of different superabrasive grain concentration disposed one after the other are disclosed in JP 9-508589 A. The small contact area of the segment to the work material of these grinding tools allows effective thrust of the abrasive grains to the work material due to the worn uneven surface of the segment with use of the tool. However, they are disadvantageously expensive for the complication of segment manufacturing.

Small thrust of the abrasive grains to the material to be grooved causes fine chips produced by grooving. Self-sharpening, the occurrence of the unused grains and the removal of the used worn grains due to the removal of the bond in the segment by wearing with the chips, of the cutting saw retains groovability or capability of grooving of the cutting saw. Fine chips of the material produced by grooving hinder the self-sharpening due to difficulty in removing the bond in the segment by the chips and consequently the groovability or capability of grooving of the cutting saw declines.

It is therefore an object of the present invention to provide a rotary cutting saw retaining groovability or capability of grooving of the rotary cutting saw.

SUMMARY OF THE INVENTION

The object indicated above may be achieved according to a first aspect of the invention, which provides a rotary cutting saw including a base disk; and a plurality of abrasive segments which are fixed to an outer circumferential surface of the base disk, and which have respective outer surfaces cooperating with each other to constitute an outer circumferential surface of the rotary cutting saw; wherein each of the abrasive segments has at least one recess opening in the outer surface thereof; wherein each of the at least one recess has a radially outer portion and a radially inner portion which is located inwardly of the radially outer portion as viewed in a radial direction of the base disk; and wherein the radially outer portion has a width that is constant in the radial direction, and the radially inner portion has a width that varies in the radial direction.

The object indicated above may be achieved according to a second aspect of the invention, which provides a rotary cutting saw, wherein the width of each of the radially outer and inner portions is a dimension of each of the at least one recess as measured in an axial direction of the base disk.

The object indicated above may be achieved according to a third aspect of the invention, which provides a rotary cutting saw wherein the width of the radially inner portion of each of the at least one recess is gradually reduced as viewed in a direction toward an axis of the base disk away from the outer circumferential surface of the base disk.

According to the feature of the first, second and third aspects of the invention, the pieces of the hard brittle material grinded by the abrasive segment are caught in the radially outer portion of the recess. The width of the radially outer portion is larger than that of the radially inner portion. The narrowness in the radially inner portion of the recess is apt to allow the pieces to be broken by oscillations and turning of the grooving machine. The pieces of the hard brittle material grinded by the abrasive segment are broken by oscillations and turning of the grooving machine in the recess and removed from there. This produces coarser pieces than those grinded by the abrasive grains in the segment. The broken pieces of the hard brittle material in the recess make the bond bonding the abrasive grains in the segment worn. Thus the high groovability or capability of grooving of the rotary cutting saw is maintained by the self-sharpening to remove the used worn grains and to bring the unused grains to the outside of the segment with pieces of the hard brittle material serving as an abrasive wearing the bond bonding the abrasive grains.

The object indicated above may be achieved according to a fourth aspect of the invention, which provides a rotary cutting saw, wherein the radially outer portion and the radially inner portion of each of the at least one recess are contiguous to each other; wherein each of the abrasive segments has a height as measured in the radial direction; and wherein the radially outer portion has a depth as measured in the radial direction, the depth being not larger than 25% of the height of each of the abrasive segments.

The object indicated above may be achieved according to a fifth aspect of the invention, which provides a rotary cutting saw, wherein the width of the radially outer portion of each of the at least one recess is defined by a first pair of surfaces which are opposed to each other and which are perpendicular to an axial direction of the base disk; and wherein the width of the radially inner portion of each of the at least one recess is defined by a second pair of surfaces each of which is contiguous to a corresponding one of the first pair of surfaces and is inclined with respect to the corresponding one of the first pair of surfaces by about 3–30 degrees.

Less than 3 degrees angle of the inclined surface, namely, each of the second pair of surfaces, with the radial direction surface causes an frequent stay of the coarse pieces of the work material, the hard brittle material, in the recess of the abrasive segment and causes ineffectiveness. More than 30 degrees angle of the inclined surface with the radial direction surface causes a resistance of cutting due to breaking in the bottom of the recess without gradual breaking of a piece of the work material along the inclined surface and causes ineffectiveness. A long way of more than 25% of the radial length of the abrasive segment from the outer circumferential surface of the rotary cutting saw to the border of the radially outer portion with the radially inner portion in the radial direction causes difficulty in breaking of the pieces of the work material in the recess due to deficient mobility of the pieces. And the long way to the border also causes ineffectiveness due to shortage of the radially inner portion in the radial direction. According to the feature of the fourth and fifth aspects of the invention, it is apt to allow the pieces to be broken by oscillations and turning of the grooving machine. Thus the high groovability or capability of grooving of the superabrasive cutting saw is maintained by the self-sharpening to remove the used worn grains and to bring the unused grains to the outside of the segment with pieces of the hard brittle material serving as an abrasive wearing the bond bonding the abrasive grains.

The object indicated above may be achieved according to a sixth aspect of the invention, which provides a rotary cutting saw, wherein each of the abrasive segments is provided by an abrasive structure which includes abrasive grains; and wherein the width of the radially outer portion of each of the at least one recess is larger than a diameter of each of the abrasive grains.

According to the feature of the sixth aspect of the invention, the size of the piece derived from the broken work material caught in the recess of the abrasive segment may be larger than that of chips produced by the abrasive grain in the abrasive segment. This expedites the self-sharpening to bring the unused grains to the outside of the segment.

The object indicated above may be achieved according to a seventh aspect of the invention, which provides a rotary cutting saw, wherein the at least one recess opening in the outer surface of each of the abrasive segments consists of a plurality of recesses which are arranged in an axial direction of the base disk.

The object indicated above may be achieved according to a eighth aspect of the invention, which provides a rotary cutting saw, wherein each of the abrasive segments has a height as measured in the radial direction, and wherein each of the at least one recess has a depth as measured in the radial direction, the depth being not smaller than 50% of the height of each of the abrasive segments.

Shortage of the recess in the radial direction of less than 50% of the radial length of the abrasive segment causes insufficiency of the pieces derived from the broken work material and caught in the recess of the abrasive segment. According to the feature of the eighth aspect of the invention, the radial length, namely, the depth of the recess of not smaller than 50% of the radial length, namely, the height of the abrasive segment causes effective breaking of the work material pieces. These broken pieces expedites the self-sharpening to bring the unused grains to the outside of the segment with the bond worn.

The object indicated above may be achieved according to a ninth aspect of the invention, which provides a rotary cutting saw, wherein each of the abrasive segments has a length as measured in a circumferential direction of the base disk, and wherein each of the at least one recess has a length as measured in the circumferential direction, the length being not smaller than 50% of the length of each of the abrasive segments.

Shortage of the recess in the circumferential direction of less than 50% of the circumferential length of the abrasive segment causes insufficiency of the pieces derived from the broken work material and caught in the recess of the abrasive segment. According to the feature of the ninth aspect of the invention, the circumferential length of the recess of not smaller than 50% of the circumferential length of the abrasive segment causes effective breaking of the work material pieces. These broken pieces expedites the self-sharpening to bring the unused grains to the outside of the segment with the bond worn. The proper design of the depth and the width of the recess, the angle of the segment radial direction surface which is perpendicular to the axial direction of the base disk with the inclined surface of the recess, and the position of the border of the segment radial direction surface with the inclined surface causes continuous advantages derived from the recess such as the life of the cutting saw.

The object indicated above may be achieved according to a tenth aspect of the invention, which provides a rotary cutting saw further includes at least one abrasive piece received in each of the at least one recess.

According to the feature of the tenth aspect of the invention, the reception of the abrasive piece in the recess expedites the self-sharpening to bring the unused grains to the outside of the segment with the bond worn and retains groovability or capability of grooving of the rotary cutting saw.

The object indicated above may be achieved according to a eleventh aspect of the invention, which provides a rotary cutting saw, wherein the at least one abrasive piece does not protrude outwardly from the outer surface of each of the abrasive segments.

The object indicated above may be achieved according to a twelfth aspect of the invention, which provides a rotary cutting saw, wherein each of said at least one abrasive piece has an abrasive structure including at least one of white alundum grain, green carborundum grain and alundum grain.

The object indicated above may be achieved according to a thirteenth aspect of the invention, which provides a rotary cutting saw, wherein each of said abrasive segments has an abrasive structure including superabrasive grains.

The object indicated above may be achieved according to a fourteenth aspect of the invention, which provides a rotary cutting saw, wherein the superabrasive grains are diamond grains.

The object indicated above may be achieved according to a fifteenth aspect of the invention, which provides a rotary cutting saw, wherein the superabrasive grains are CBN (Cubic boron nitride) grains.

According to the feature of the eleventh, twelfth, thirteenth, fourteenth and fifteenth aspects of the invention, the surface of the abrasive segment is dressed and the self-sharpening to bring the unused grains to the outside of the segment with the bond worn is expedited.

DETAILED DESCRIPTION OF EXEMPLARY EMBODIMENTS

Figure 1:
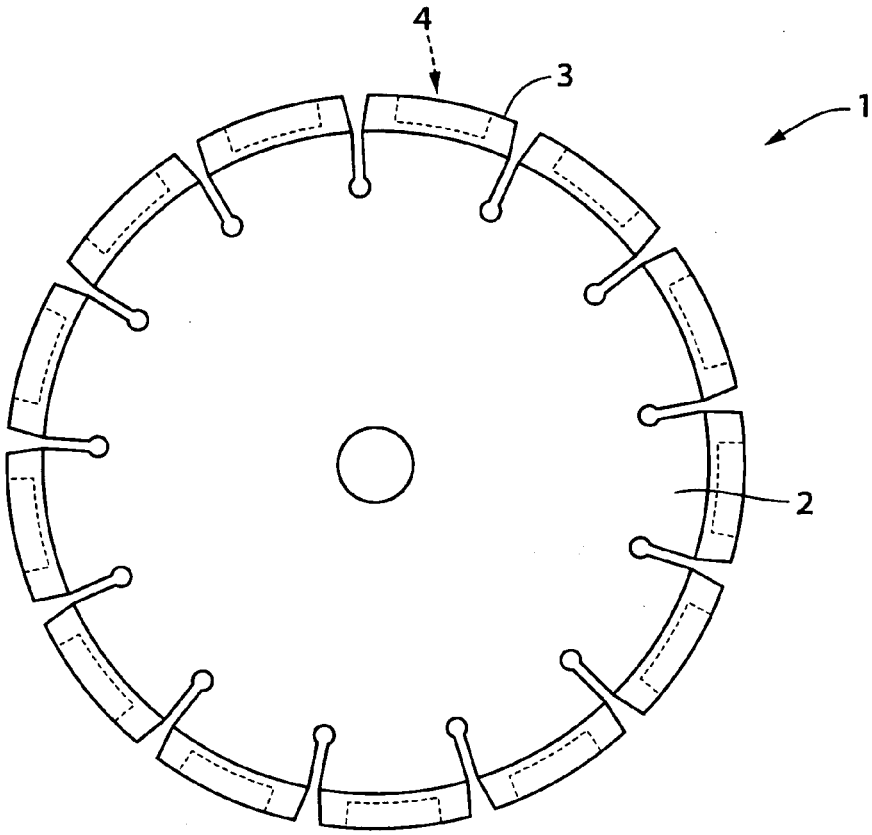
FIG. 1 illustrates the rotary cutting saw according to the invention in a front view.

Hereinafter, there will be described a rotary cutting saw by reference to the drawings. The first embodiment is referred to as follows. In FIGS. 1, 2, 3A, 3B and 3C, the rotary cutting saw 1 is provided with a base disk 2 and a plurality of abrasive segments 3 which are fixed to an outer circumferential surface of the base disk 2 and which have respective outer surfaces, namely, outer circumferential surfaces 31, cooperating with each other to constitute an outer circumferential surface of the rotary cutting saw 1. Each of the abrasive segments 3 has at least one recess 4 opening in the outer surface thereof. Each of the at least one recess 4 has a radially outer portion 10 and a radially inner portion 12 which is located inwardly of the radially outer portion 10 as viewed in a radial direction R of the base disk 2, the radially outer portion 10 has a width that is constant in the radial direction R and the radially inner portion has a width that varies in the radial direction R. The width of each of the radially outer and inner portions 10, 12 is a dimension of each of the at least one recess 4 as measured in an axial direction A of the base disk 2. The width of the radially inner portion 12 of each of the at least one recess 4 is gradually reduced as viewed in a direction toward an axis of the base disk 2 away from the outer circumferential surface of the base disk 2. In other words, the rotary cutting saw 1 includes the base disk 2 and a plurality of the abrasive segments 3 fixed to the outer circumferential surface of the base disk 2. The outer circumferential surface side is referred to as a side of the abrasive segment 3 to contact a work material and the bottom surface side is referred to as a side of the abrasive segment 3 to be fixed to the base disk 2. The recess 4 has a constant width between the outer circumferential surface 31 of the abrasive segment 3 and a predetermined point in depth, namely, in a direction from the outer circumferential surface side toward the bottom surface side, and the width of the recess 4 is narrower than that at an upper point in depth between the predetermined point in depth and a bottom of the recess 4.

Figure 3A:
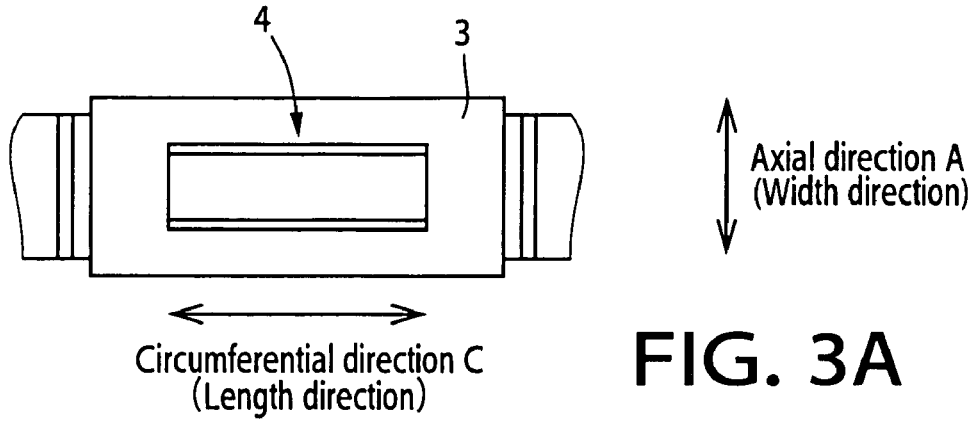
FIG. 3A illustrates a part of the rotary cutting saw according to the first embodiment of the invention in a plan view.
Figure 3B:
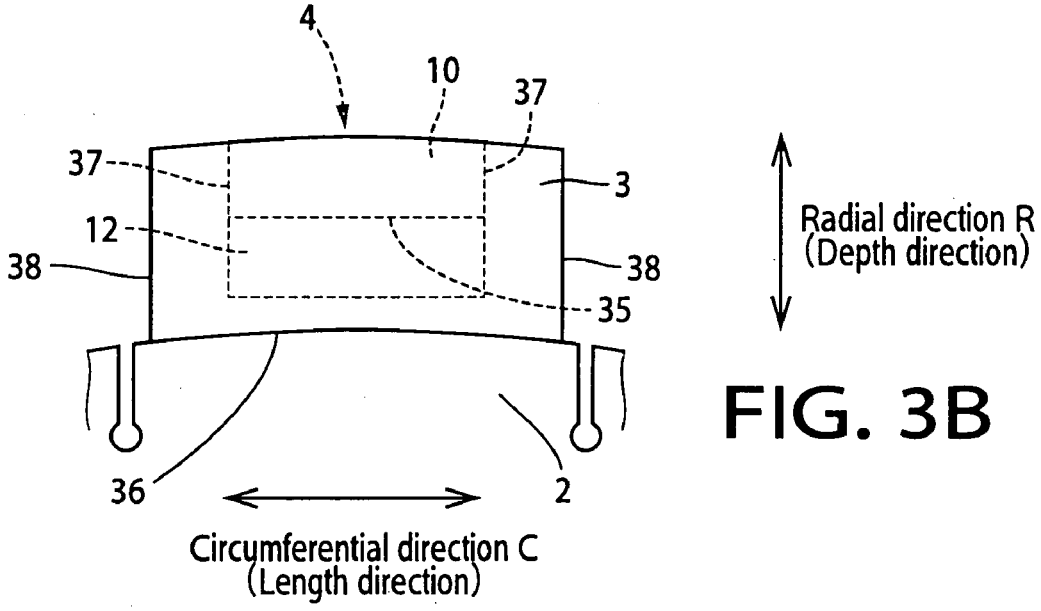
FIG. 3B illustrates a part of the rotary cutting saw according to the first embodiment of the invention in a front view.
Figure 3C:
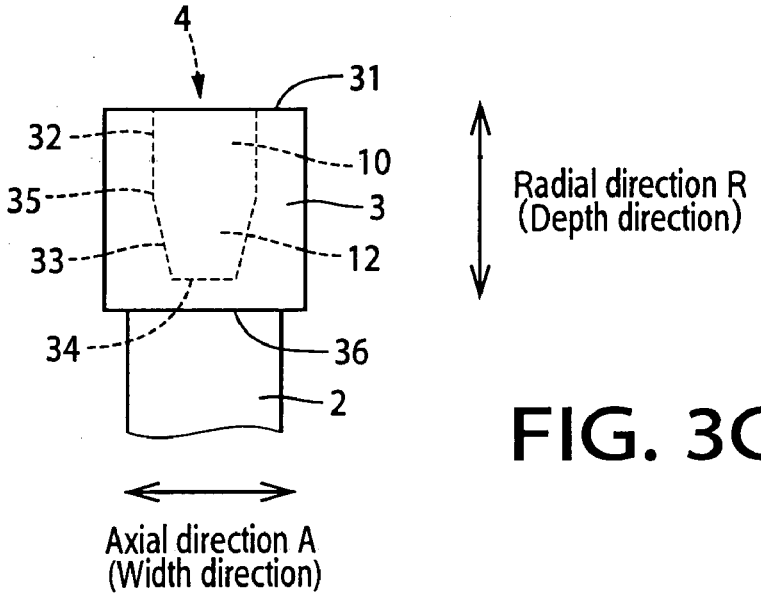
FIG. 3C illustrates a part of the rotary cutting saw according to the first embodiment of the invention in a side view.
Figure 4:
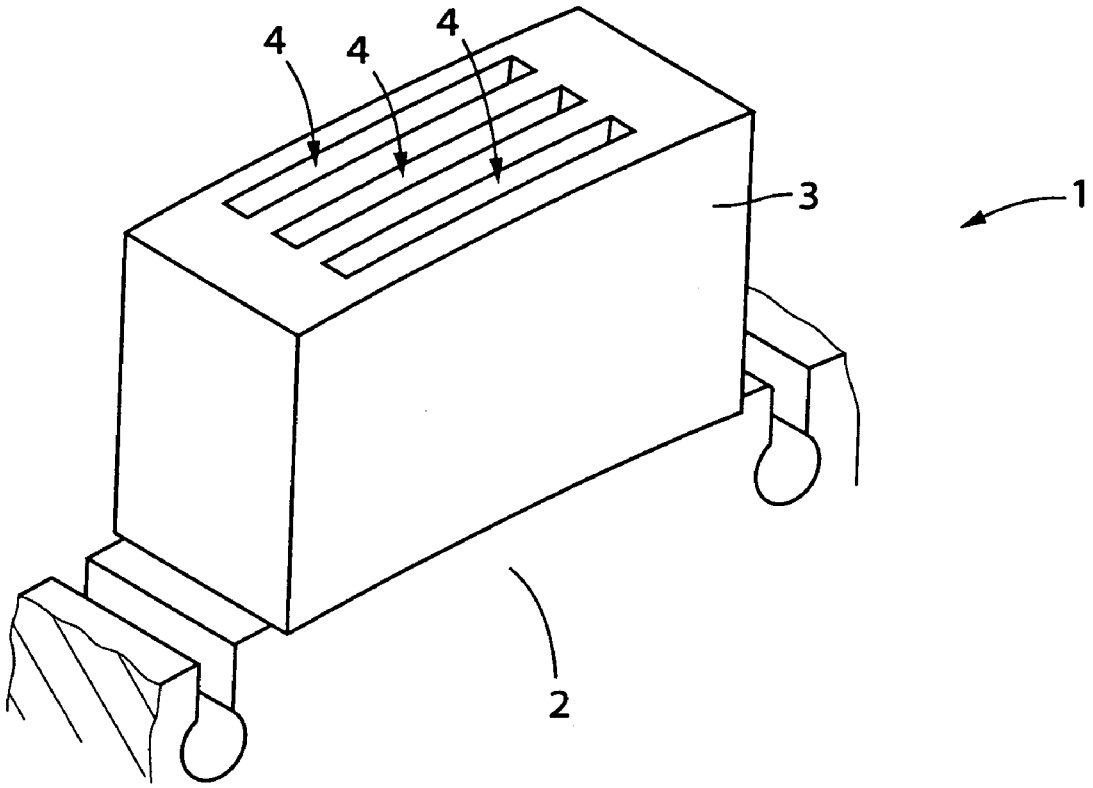
FIG. 4 illustrates a part of the rotary cutting saw according to the second embodiment of the invention in a perspective view.
Figure 5A:
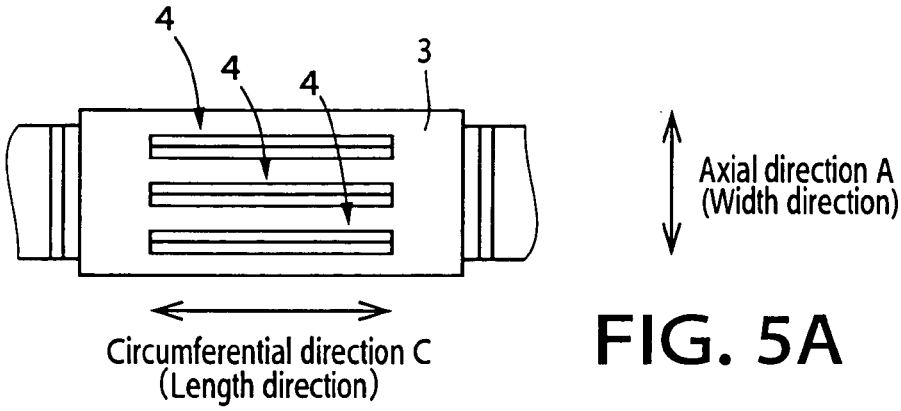
FIG. 5A illustrates a part of the rotary cutting saw according to the second embodiment of the invention in a plan view.
Figure 5B:
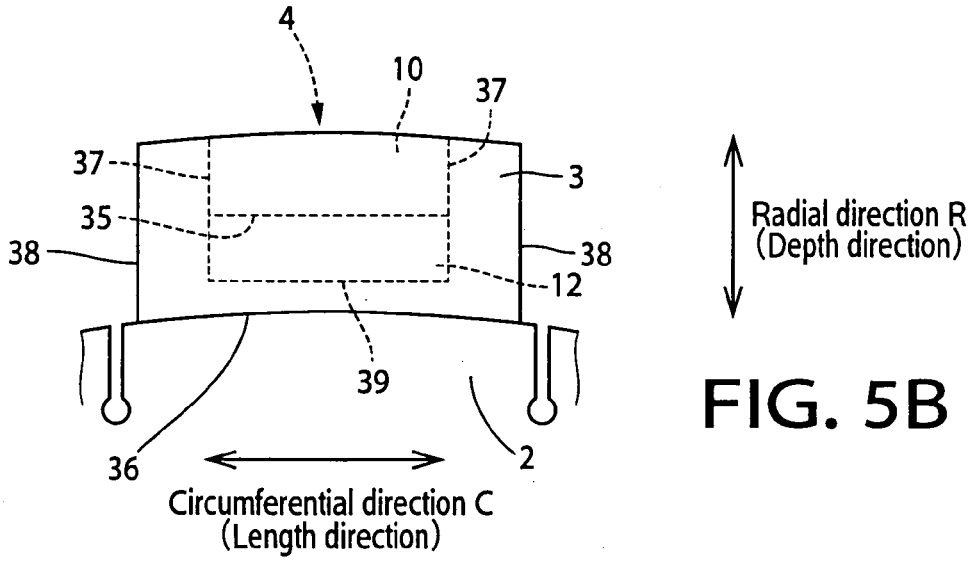
FIG. 5B illustrates a part of the rotary cutting saw according to the second embodiment of the invention in a front view.
Figure 5C:
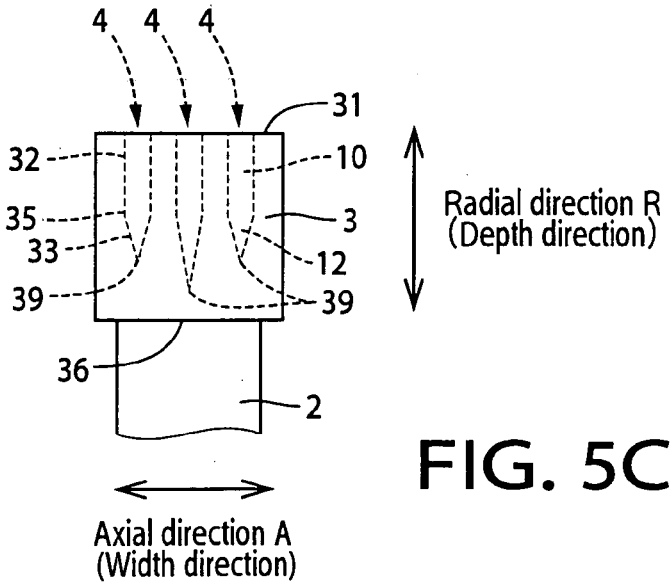
FIG. 5C illustrates a part of the rotary cutting saw according to the second embodiment of the invention in a side view.
Figure 6:
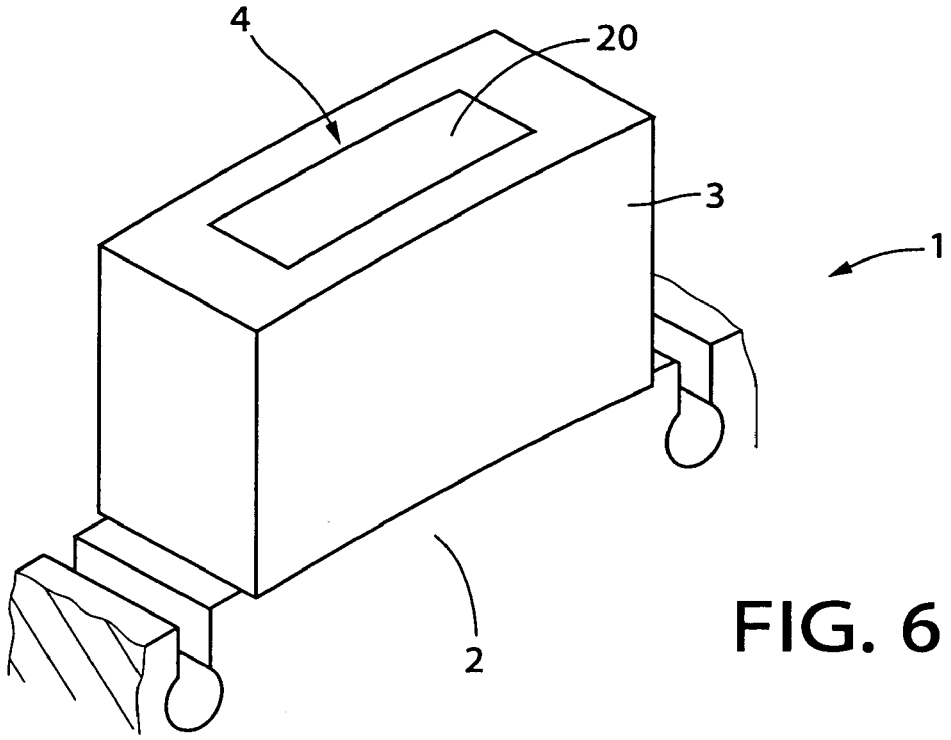
FIG. 6 illustrates a part of the rotary cutting saw according to the first embodiment of the invention in a perspective view in which the recess receives an abrasive piece.
Figure 7:
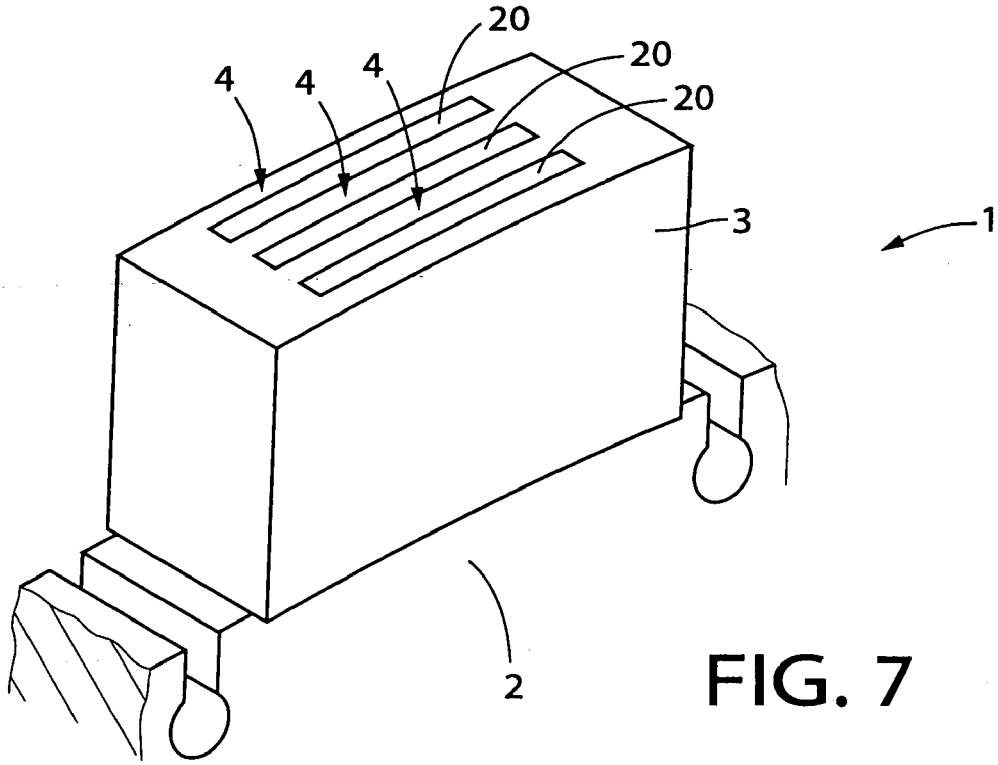
FIG. 7 illustrates a part of the rotary cutting saw according to the second embodiment of the invention in a perspective view in which the recesses receive abrasive pieces.

In FIGS. 3B and 3C, the width of the radially outer portion 10 of each of the at least one recess 4 is defined by a first pair of surfaces which are opposed to each other and which are perpendicular to an axial direction of the base disk, and the width of the radially inner portion 12 of each of the at least one recess 4 is defined by a second pair of surfaces each of which is contiguous to a corresponding one of the first pair of surfaces and is inclined with respect to the corresponding one of the first pair of surfaces by about 3–30 degrees, more preferably about 5–10 degrees. In other words, the recess 4 is defined by the radial direction surfaces 32, the inclined surfaces 33 inclined at a predetermined angle with the radial direction surfaces 32, the axial direction surfaces 37 and the bottom surface 34, and the inclined surface inclines at about 3–30 degrees, more preferably about 5–10 degrees, with the radial direction surface 32.

The radially outer portion 10 and the radially inner portion 12 of each of the at least one recess 4 are contiguous to each other, each of the abrasive segments 3 has a height as measured in the radial direction R, and the radially outer portion 10 has a depth as measured in the radial direction R, the depth being not larger than 25%, more preferably 15–20%, of the height of each of the abrasive segments 3. In other words, the depth from the outer circumferential surface 31 of the abrasive segment 3 to the border 35, namely, the surface direction change point, of the radial direction surface 32 with the inclined surface 33 is set within 25%, more preferably 15–20%, of the height of the abrasive segment, namely, the length between the outer circumferential surface 31 and the bottom 36 of the segment 3. The surface direction change point is where the radial direction surface 32 meets the inclined surface 33.

Each of the abrasive segments 3 is provided by an abrasive structure which includes abrasive grains, and the width of the radially outer portion 10 of each of the at least one recess 4 is larger than a diameter of each of the abrasive grains. Each of the abrasive segments 3 has a height as measured in the radial direction R, each of the at least one recess 4 has a depth as measured in the radial direction R, and the depth is not smaller than 50%, more preferably 50–80%, of the height of each of the abrasive segments 3. In other words, the depth, namely, the length between the outer circumferential surface 31 and the bottom surface 34 in the radial direction R, of the recess is not smaller than 50%, more preferably 50–80%, of the height of the abrasive segment 3. Each of the abrasive segments 3 has a length as measured in a circumferential direction C of the base disk 2, each of the at least one recess 4 has a length as measured in the circumferential direction C, and the length is not smaller than 50%, more preferably 70–90%, of the length of each of the abrasive segments 3. In other words, the circumferential length, namely, the length between the axial direction surfaces 37 in the circumferential direction C, of the recess 4 is not smaller than 50%, more preferably 70–90%, of the circumferential length, namely, the length between the end surfaces 38 of the abrasive segment 3.

The second embodiment is referred to as follows. In FIGS. 4, 5A, 5B and 5C, the rotary cutting saw 1 is provided with a base disk 2 and a plurality of abrasive segments 3 which are fixed to an outer circumferential surface of the base disk 2 and which have respective outer surfaces, namely, outer circumferential surfaces 31, cooperating with each other to constitute an outer circumferential surface of the rotary cutting saw 1. Each of the abrasive segments 3 has at least one recess 4 opening in the outer surface thereof. Each of the at least one recess 4 has a radially outer portion 10 and a radially inner portion 12 which is located inwardly of the radially outer portion 10 as viewed in a radial direction R of the base disk 2, the radially outer portion 10 has a width that is constant in the radial direction R and the radially inner portion has a width that varies in the radial direction R. The width of each of the radially outer and inner portions 10, 12 is a dimension of each of the at least one recess 4 as measured in an axial direction A of the base disk 2. The width of the radially inner portion 12 of each of the at least one recess 4 is gradually reduced as viewed in a direction toward an axis of the base disk 2 away from the outer circumferential surface of the base disk 2. In other words, the rotary cutting saw 1 also includes a base disk 2 and a plurality of abrasive segments 3 fixed to the base disk 2 on an outer circumferential surface. The abrasive segment 3 has a recess 4 opening in the outer circumferential surface side. The outer circumferential surface side is referred to as a side of the abrasive segment 3 to contact a work material and the bottom surface side is referred to as a side of the abrasive segment 3 to be fixed to the base disk 2. The at least one recess 4 opening in the outer surface of each of the abrasive segments 3 consists of a plurality of recesses 4 which are arranged in an axial direction A of the base disk 2.

The recess 4 has, for example, a rectangular opening, and has a constant width between the outer circumferential surface 31 of the abrasive segment 3 and a predetermined point in depth, namely, in a direction from the outer circumferential surface side toward the bottom surface side, and the width of the recess 4 is narrower than that at an upper point in depth between the predetermined point in depth and a bottom of the recess 4. The recess 4 is defined by the radial direction surfaces 32, the inclined surfaces 33 inclined at a predetermined angle with the radial direction surfaces 32 and the axial direction surfaces 37.

Each of the abrasive segments 3 is provided by an abrasive structure which includes abrasive grains, and the width of the radially outer portion 10 of each of the at least one recess 4 is larger than a diameter of each of the abrasive grains. Each of the abrasive segments 3 has a height as measured in the radial direction R, each of the at least one recess 4 has a depth as measured in the radial direction R, and the depth is not smaller than 50% of the height of each of the abrasive segments 3. In other words, The depths, namely, the lengths between the outer circumferential surface 31 and the bottom 39 in the radial direction R, of the recesses 4 may be different one another and are preferably not smaller than 50% of the height of the abrasive segment 3. The recesses 4 may have a predetermined length in the circumferential direction C and may be disposed in different positions, different from those shown in FIG. 5A, in the circumferential direction C. The recesses 4 may vary in their shapes. As shown in FIG. 3C, for example, a plurality of the recesses having the same shape defined by the radial direction surfaces 32, the inclined surfaces 33, the axial direction surfaces and the bottom surface 34 as that of the first embodiment may be arranged.

The following is the description of the action of the rotary cutting saw according to the invention. The grooving working progresses with the abrasive grains of the cutting saw in contact with the brittle materials such as stone, concrete and refractories. Concrete, for example, is grinded by the abrasive grains in the abrasive segment 3, and the broken concrete pieces that contacts the upper area of the recess 4 are received in the recess 4 of the segment 3. The width of the upper portion (namely, radially outer portion 10) allows the recess 4 to easily receive the broken concrete pieces contacting the upper area of the recess 4.

The narrowness on the bottom surface side in the radially inner portion 12 of the recess 4 allows the pieces to be easily broken by oscillations and turning of the grooving machine. The broken pieces of the hard brittle material contacting the upper area of the recess 4 are further broken by oscillations and turning of the grooving machine in the recess 4 and removed from there. The desired size of the broken concrete piece received in the recess 4 is achieved by setting the width, length and depth of the recess 4, the angle of the inclined surface 33 with the radial direction surface 32.

This broken concrete piece is larger than the concrete piece grinded by the abrasive grains in the abrasive segment 3. Thus this produces coarser concrete pieces than the pieces (chips) by a conventional cutting saw having superabrasive segments without any recess therein. The broken pieces of the hard brittle material in the recess 4 make the bond bonding the abrasive grains in the segment 3 worn in grooving a hard material such as hard concrete and stone which considerably wears abrasive grains. Thus the high groovability or capability of grooving of the cutting saw 1 is maintained by the self-sharpening to remove the used worn grains and to bring the unused grains to the outside of the segment 3 with pieces of the hard brittle material serving as an abrasive wearing the bond bonding the abrasive grains. And also the self-sharpening progresses by designing the preferable shape of the recess 4 as described above for the quality of a material to be grooved with the preferable size of the concrete piece received in the recess 4.

While the rotary cutting saw having abrasive segments with empty recesses is referred to above, burned and formed abrasive pieces made from abrasive grains such as white alundum (WA) grains, green carborundum (GC) grains and alundum (A) grains with a bond such as a vitrified bond may be received in the recesses 3. The self-sharpening, the occurrence of the unused grains and the removal of the used worn grains due to the removal of the bond in the segment 3 by wearing with the abrasive pieces 20 received in the recesses 4, of the cutting saw 1 retains groovability or capability of grooving of the superabrasive cutting saw. The abrasive piece 20 received in the recess 4 is broken into smaller ones by a contact of the outer surface of the segment 3 with the work material and the smaller ones progresses the self-sharpening of the segment 3. The abrasive piece 20 may have the desired quality of the material, the desired grain size and the desired degree of bond for cutting efficiency of the cutting saw 1 and hardness of the work material. Supplement of the formed abrasive pieces made after the temporary shape of the recess 4 into the recess 4 through adhesives may be achieved in deficiency in the abrasives resulted from worn abrasive pieces. The abrasive piece 20 is preferably received in the recess 4 such that the abrasive piece 20 does not protrude outwardly from the outer surface of the abrasive segment 3.

Figure 2:
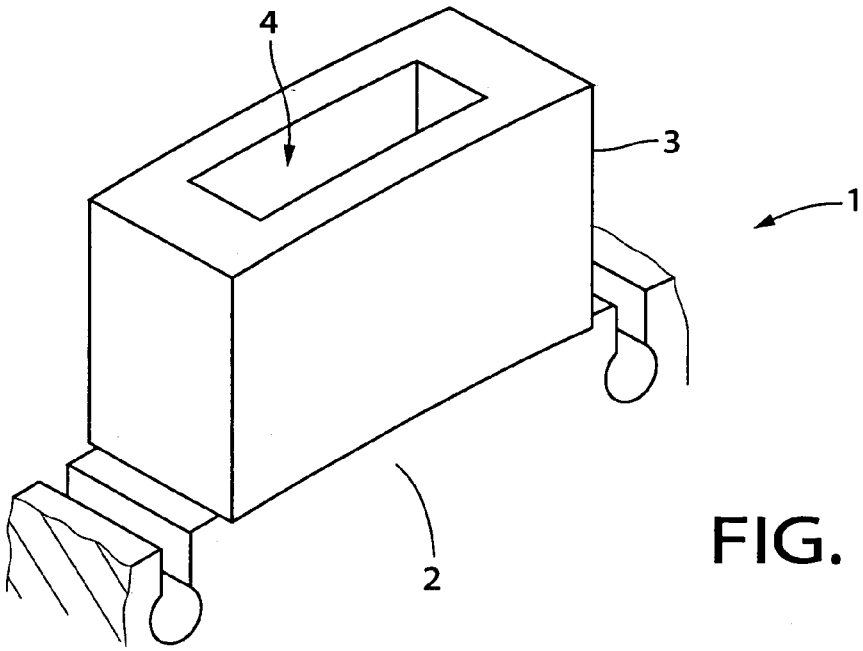
FIG. 2 illustrates a part of the rotary cutting saw according to the first embodiment of the invention in a perspective view.

The inventor made a rotary cutting saw according to the invention as shown in FIGS. 1 and 2. This is referred to as "Invention I". The saw has dimensions of 305D×45L×6T×

8X×18N and the segment 3 including superabrasive grains is 6.0 mm in width, 8.0 mm in height and 45.0 mm in length. The recess 4 in the segment 3 is 2.0 mm in width, 40.0 mm in length and 6.0 mm in depth. The angle of the inclined surface 33 with the radial direction surface 32 is set as 10 degrees. The depth of the border 35 of the inclined surface 33 with the radial direction surface 32 is set as 2 mm from the outer surface of the segment 3. The bond includes 50 wt % of cobalt, 20 wt % of iron and 30 wt % of copper. The diameter of the diamond grain is 420 μm on average and the concentration is 20.

And the inventor made the same rotary cutting saw as the Invention I and inserted abrasive pieces 20 into the recesses 4 of the segment 3. The abrasive pieces 20 include GC (Green Carborundum) of the grain size of #46. This is referred to as "Invention II".

Furthermore, the inventor made another rotary cutting saw as well as the Invention I except for recesses 4 for a comparative purpose. It has no recesses 4. This is referred to as "Comparative".

The inventor experimented in grooving concrete for 10 mm in depth with grooving machines having respective 10 cutting saws with spacers therebetween of the Invention I, the Invention II and the Comparative. The grooving was done with 36,775 W (50 hp) of the output of the grooving machine, 2,500 $min^{-1}$ of the rotational speed of the main shaft and 600 $kg/cm^2$ of the compressive stress of the concrete, the object of grooving. The cutting saw of the Invention I grooved the concrete in the efficiency of 1.8 m/min, the saw of the Invention II did in the efficiency of 2.0 m/min and the Comparative did in the efficiency of 1.0 m/min. The efficiency in grooving means the distance that the cutting saw grooves per unit time. Thus the recesses 4 according to the present invention cause high efficiency in grooving. Furthermore, the recesses 4 having the abrasive pieces 20 in them cause higher efficiency in grooving.

It is to be understood that the present invention may be embodied with other changes, improvements, and modifications that may occur to a person skilled in the art without departing from the scope and spirit of the invention defined in the appended claims.

What is claimed is:

1. A rotary cutting saw comprising:

a base disk; and a plurality of abrasive segments which are fixed to an outer circumferential surface of the base disk, and which have respective outer surfaces cooperating with each other to constitute an outer circumferential surface of the rotary cutting saw;

wherein each of the abrasive segments has at least one recess opening in the outer surface thereof, the recess is defined by axial direction surfaces that are opposite to each other as viewed in a circumferential direction of the base disk, and the recess has a same sectional shape between the axial direction surfaces as viewed in the circumferential direction and no interconnect structure connects two opposite radial direction surfaces that are opposite to each other as viewed in an axial direction of the base disk;

wherein each of the at least one recess has a radially outer portion and a radially inner portion which is located inwardly of the radially outer portion as viewed in a radial direction of the base disk;

and wherein the radially outer portion has a width that is constant in the radial direction, and the radially inner portion has a width that varies in the radial direction.

2. The rotary cutting saw according to claim 1, wherein the width of each of the radially outer and inner portions is a dimension of each of the at least one recess as measured in an axial direction of the base disk.

3. The rotary cutting saw according to claim 1, wherein the width of the radially inner portion of each of the at least one recess is gradually reduced as viewed in a direction toward an axis of the base disk away from the outer circumferential surface of the base disk.

4. The rotary cutting saw according to claim 3, wherein the radially outer portion and the radially inner portion of each of the at least one recess are contiguous to each other, wherein each of the abrasive segments has a height as measured in the radial direction, and wherein the radially outer portion has a depth as measured in the radial direction, the depth being not larger than 25% of the height of each of the abrasive segments.

5. The rotary cutting saw according to claim 4, wherein the width of the radially outer portion of each of the at least one recess is defined by a first pair of surfaces which are opposed to each other and which are perpendicular to an axial direction of the base disk, and wherein the width of the radially inner portion of each of the at least one recess is defined by a second pair of surfaces each of which is contiguous to a corresponding one of the first pair of surfaces and is inclined with respect to the corresponding one of the first pair of surfaces by about 3–30 degrees.

6. The rotary cutting saw according to claim 1, wherein each of the abrasive segments is provided by an abrasive structure which includes abrasive grains, and wherein the width of the radially outer portion of each of the at least one recess is larger than a diameter of each of the abrasive grains.

7. The rotary cutting saw according to claim 1, wherein the at least one recess opening in the outer surface of each of the abrasive segments consists of a plurality of recesses which are arranged in an axial direction of the base disk.

8. The rotary cutting saw according to claim 1, wherein each of the abrasive segments has a height as measured in the radial direction, and wherein each of the at least one recess has a depth as measured in the radial direction, the depth being not smaller than 50% of the height of each of the abrasive segments.

9. The rotary cutting saw according to claim 1, wherein each of the abrasive segments has a length as measured in a circumferential direction of the base disk, and wherein each of the at least one recess has a length as measured in the circumferential direction, the length being not smaller than 50% of the length of each of the abrasive segments.

10. The rotary cutting saw according to claim 1, further comprising at least one abrasive piece received in each of the at least one recess.

11. The rotary cutting saw according to claim 10, wherein the at least one abrasive piece does not protrude outwardly from the outer surface of each of the abrasive segments.

12. The rotary cutting saw according to claim 10, wherein each of said at least one abrasive piece has an abrasive structure including at least one of white alundum grain, green carborundum grain and alundum grain.

13. The rotary cutting saw according to claim 10, wherein each of said abrasive segments has an abrasive structure including superabrasive grains.

14. The rotary cutting saw according to claim 13, wherein the superabrasive grains are diamond grains.

15. The rotary cutting saw according to claim 13, wherein the superabrasive grains are CBN (Cubic boron nitride) grains.

* * * * *